US008071921B2

(12) United States Patent
Lewin

(10) Patent No.: US 8,071,921 B2
(45) Date of Patent: Dec. 6, 2011

(54) METHOD TO SUPPLY ELECTRIC CURRENT TO A TUBE FURNACE

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 1257 days.

(21) Appl. No.: 10/540,679

(22) PCT Filed: Dec. 4, 2003

(86) PCT No.: PCT/SE03/01886

§ 371 (c)(1),
(2), (4) Date: Mar. 25, 2008

(87) PCT Pub. No.: WO2004/057917

PCT Pub. Date: Jul. 8, 2004

(65) Prior Publication Data

US 2009/0020519 A1 Jan. 22, 2009

(30) Foreign Application Priority Data

Dec. 23, 2002 (SE) ..... 0203844

(51) Int. Cl.

| | |
|---|---|
| ***H05B 3/02*** | (2006.01) |
| ***H05B 3/42*** | (2006.01) |
| ***F27B 5/00*** | (2006.01) |
| ***F27B 5/14*** | (2006.01) |
| ***F27D 11/02*** | (2006.01) |

(52) U.S. Cl. ..... 219/541; 219/427; 373/125

(58) Field of Classification Search ..... 219/427
See application file for complete search history.

(56) References Cited

U.S. PATENT DOCUMENTS

| | | | | |
|---|---|---|---|---|
| 3,271,561 | A * | 9/1966 | Fiedler et al. | 392/388 |
| 3,974,561 | A * | 8/1976 | Schnoeller | 29/611 |
| 4,247,735 | A * | 1/1981 | Rigatti-Luchini | 373/29 |
| 4,286,142 | A | 8/1981 | Taylor | 219/390 |
| 5,239,614 | A * | 8/1993 | Ueno et al. | 392/416 |
| 5,869,810 | A * | 2/1999 | Reynolds et al. | 219/388 |

FOREIGN PATENT DOCUMENTS

EP 0 819 905 A1 1/1998

* cited by examiner

*Primary Examiner* — Joseph M Pelham
(74) *Attorney, Agent, or Firm* — Alfred J. Mangels

(57) ABSTRACT

A method of and an arrangement for transmitting electric current to a furnace that is heated, either completely or partially, by electric current conducted in the furnace wall. The current is conducted through electrically conductive devices connected to the furnace wall. At least one of the devices in proximity to the furnace wall includes a section that has a smaller cross-sectional area than the remainder of the device. The current flow through the smaller cross-section develops heat in the region of the smaller section of a magnitude that corresponds substantially to the heat magnitude that would have been conducted from the furnace wall to the electrically conductive device in the absence of the smaller cross-sectional area.

14 Claims, 4 Drawing Sheets

METHOD TO SUPPLY ELECTRIC CURRENT TO A TUBE FURNACE

BACKGROUND OF THE INVENTION

1. Field of the Invention

The present invention relates to electrically heated furnaces, and more particularly to electrically heated furnaces in which the heating within the furnace takes place as a result of an electric current that flows into a wall of the furnace.

2. Description of the Related Art

In furnace operations, high demands are often placed on the insulation of the heated volume. High demands are also placed on the requirement of uniform temperature distribution within the furnace in respect of different applications. In other words, the greatest acceptable temperature difference throughout the heated volume is often very low. In other applications, it is desired to check and control temperature distribution to a very high degree of accuracy in accordance with a predefined distribution.

Examples of such applications are furnaces for single crystal growth, diffusion furnaces and tube-like furnaces where electric current through the tube wall generates the thermal energy that heats the enclosed volume of the furnace. This heating of the furnace volume requires a high amperage input, which means that the devices through which electric current is taken into and out of the furnace must have a large cross-sectional surface area. The furnace may be a continuous conveyor furnace having open ends, or a furnace that fully encloses the furnace volume.

Tube-like furnace may consist of a tube to which current is supplied. The tube may include an internal ceramic lining. The tube may also be a process tube situated within a surrounding heating coil.

When a temperature gradient exists between the furnace and its surroundings, all devices that are in direct contact with the furnace surface will lead thermal energy away from the furnace to the colder surroundings. This thermal energy drain takes place from the point at which the device concerned is in contact with the furnace surface and is more effective the better the device conducts heat and the larger the contact surface is between said device and the furnace.

Examples of such devices include supports for holding the furnace in place, different measuring devices, and current outlets for supplying current to the furnace surface or leading current away from said surface. These devices are often made of metal and are therefore good heat conductors. When the device in question is a current input device, large electrical contact surfaces are often required due to the strong current required to heat the furnace to the desired temperature.

Typical working conditions for a given type of electrically-heated tube-like furnace include temperatures of from 500-1200° C. inclusive. At these temperatures, a typical highest acceptable deviation from the predetermined temperature distribution in the furnace is 10-20° C. When heating material for single crystal growth by diffusion, the temperature range may be 500-1400° C. with an accuracy of +/−0.1° C. The electric currents required to achieve such working temperatures are so strong as to require the use of relatively powerful current input devices.

Other types of furnaces may be heated in ways other than by supplying electrical energy to the furnace casing. Furthermore, different devices that do not normally conduct current may be applied to the furnace casing and thereby cause the punctiform flow of thermal energy from the heated furnace volume.

SUMMARY OF THE INVENTION

Accordingly, the present invention relates to a method of transmitting electric current to a furnace which is heated, either totally or partially, by current conducted in the furnace wall, and where electric current is conducted through devices lying against or connected to the furnace wall. At least one of said devices has close to the furnace wall a section whose cross-sectional area is smaller than the remaining part of the device in question. The electric current passing through said smaller cross-sectional area causes in said region of smaller cross-sectional area the development of heat that corresponds substantially or totally to the heat transfer that would have taken place from the furnace wall to the device in the absence of said smaller cross-sectional area.

The invention also relates to a furnace arrangement.

BRIEF DESCRIPTION OF THE DRAWINGS

The invention will now be described in more detail partly in connection with the embodiments of the invention shown in the accompanying drawings, in which.

DESCRIPTION OF THE PREFERRED EMBODIMENTS

Figure 1:
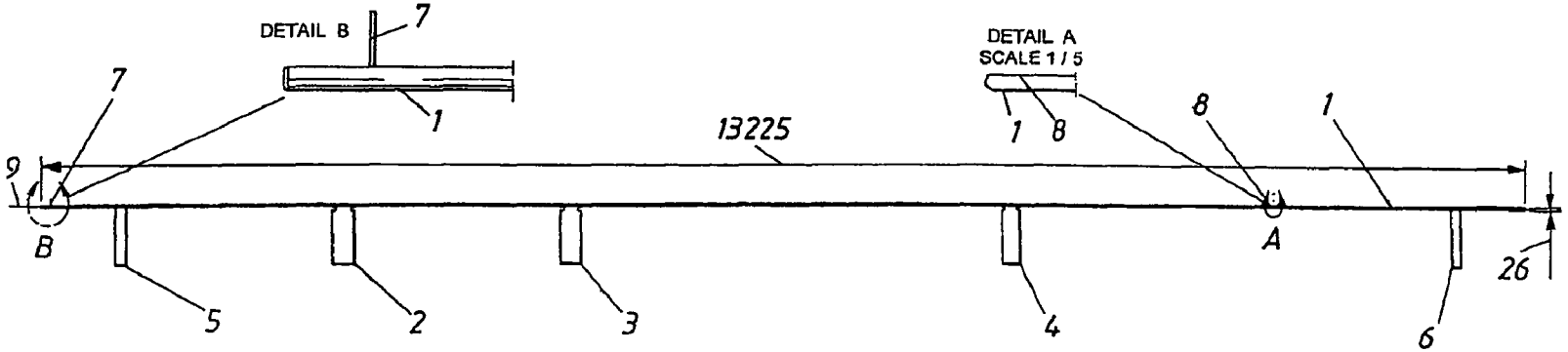
FIG. 1 is a general view of a preferred embodiment of the present invention.

FIG. 1 is a side view of a so-called tube-like furnace according to one embodiment of the present invention, with dimensions given in millimeters. The furnace is of the so-called continuous conveyor furnace type and has the form of a long open cylinder, a so-called annealing tube, whose barrel surface 1 constitutes the furnace casing operative in the process. The casing consists of an electrically conductive material, preferably a metal or a metal alloy. Products such as wire, for instance, are annealed in such furnaces.

The invention can as well be applied with a tube-like furnace for batch-wise heating of products, in which case the ends of the tube are closed during product heating operations. Furnaces of this nature may be used, for instance, in the manufacture of electronic circuits.

NiCr is a typical metal alloy used in furnace manufacture. However, this metal alloy spatters at high temperatures, due to material oxidation. This spattering influences the mass distribution of the furnace casing and therewith its electrical resistance. In turn, this makes control of the furnace temperature difficult to achieve as a result of the strength of the current applied. For this reason, FeCrAl is a preferred material in respect of tube-like furnaces according to the present invention, since this material does not splatter.

A number of electric current devices 2-6 are connected to the furnace casing, of which certain terminals 2-4 are current input devices and the remaining terminals 5,6 are current drainage or current discharge devices. Electric current is caused to flow into the furnace casing 1 through the current input devices 2-4 and to leave the tube-like furnace through the current drainage devices 5, 6, by applying an electric voltage across the current input devices 2-4 and the current drainage devices 5, 6. Because of the power developed in the furnace casing 1, the current will heat the enclosed furnace volume as a result of the electrical resistance in the casing 1.

The voltage across each pair of current input devices and current drainage devices can be adjusted individually, so as to enable the current therebetween to be controlled. This enables the object of being able to control heating of the enclosed furnace volume to be achieved, so that the magnitude of the heating effect will be different at different places along the longitudinal axis 9 of the furnace.

Thus the furnace power supply, and therewith its temperature distribution, can be controlled in a very precise manner by appropriate placement of the current input devices 2-4 and current drainage devices 5, 6 and the application of an appropriate voltage thereacross, as will be understood by the person skilled in this art. The volume whose temperature it is desired to control in the tube-like furnace of FIG. 1 may be that part of the enclosed furnace volume situated between the current input device 2 and a respective current input device 3 or 4, and the current output devices 5 and 6, respectively.

One problem with this construction is that heat is dissipated from the furnace casing 1 through the current input devices, since said devices are in direct contact with the furnace casing. This heat dissipation contributes to the disturbance of the predefined temperature distribution desired with regard to the enclosed furnace volume.

Figure 2:
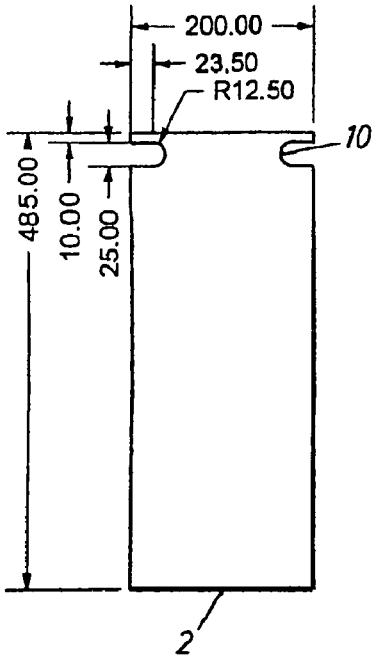
FIGS. 2-6 are cross-sectional views of different examples of preferred embodiments of electrically conductive devices according to the present invention.
Figure 3:
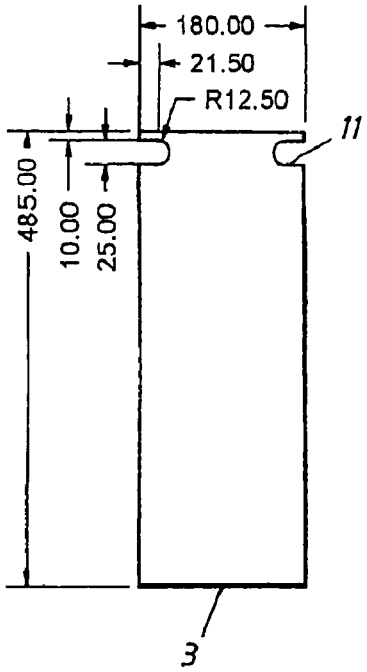
Figure 4:
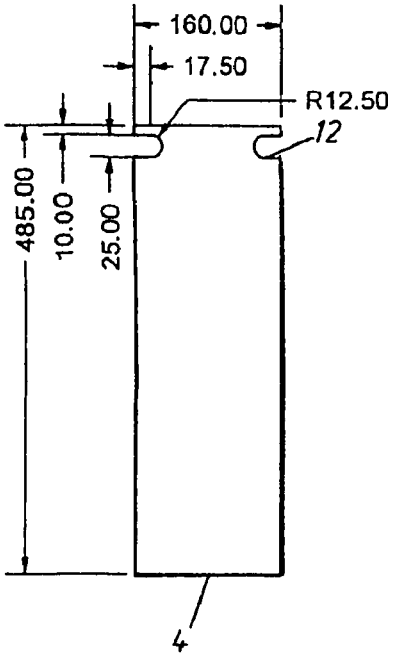
Figure 5:
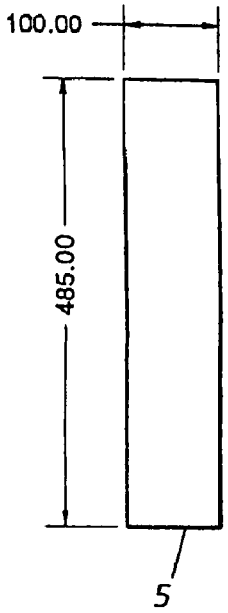
Figure 6:
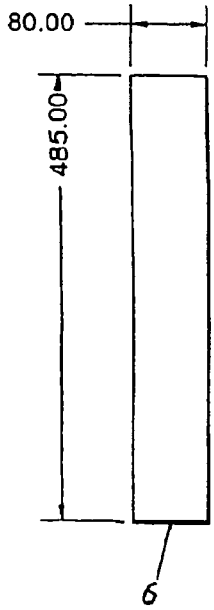

With the intention of balancing this heat loss, the current input devices 2-4, placed in the vicinity of the region of the enclosed furnace volume whose temperature is to be controlled are provided with a waist 10-12 (see FIGS. 2-4). In other words, there is provided on each such current input device 2-4 a waist region 10-12 whose cross-sectional area is much smaller than the cross-sectional area of the remainder of said current input device. As a result of the smaller cross-sectional area at the waist regions 10-12, the electrical resistance offered to the current through the devices 2-4 is greater in the waist regions 10-12 than in the remaining parts of respective devices 2-4. As current flows through the input devices 2-4, power is developed as a result of the electrical resistance of said devices and by the current that flows through the devices 2-4. This power development contributes to a heat surplus in each current input device 2-4, thereby causing the furnace casing 1 to be heated punctiformly at the contact surface between the input device 2-4 and the casing 1. By adjusting the cross-sectional area at the waist regions 10-12, the person skilled in this art will be able to balance this input of energy to the furnace casing 1 against the energy losses resulting from heat dissipation through the current input devices 2-4, and thereby achieve a zero net flow of thermal energy from the furnace to the surroundings through said input devices 2-4. This net contribution to heating of the enclosed furnace volume will therefore not influence the temperature distribution in the furnace. The waist is located close to the barrel surface of the tube so as to reduce the size of the surface of the input device located between the waist and the tube wall, this surface being cooled by the surroundings.

Instead of providing the current input device with a waist, the current density can be increased by removing material from the central part of said device, for instance by providing a hole therein.

The tube-like furnace can be held in a desired position with the aid of different types of supports (not shown in the figure). These supports lie in direct contact with the barrel surface of the furnace and therewith contribute to the drainage of thermal energy from the furnace surface 1 to the surroundings through the support surfaces in contact with the furnace housing 1, in much the same way as do the current input devices, resulting in a temperature imbalance in the heated furnace volume.

Similar to the electric current input devices 24, the supports can be made of an electrically conductive material and a voltage can be applied across the supports so as to cause current to flow therethrough, wherewith the applied current through the resistance effect will contribute to the flow of heat into the furnace housing 1 through the cross-sectional area of the supply. The net heat flow loss can be brought to zero, by regulating the applied voltage and by adjusting the cross-sectional area of the support. In a preferred embodiment, the electrical resistance of the support is influenced by providing the support in the proximity of its contact surface with the tubular casing 1 with a waist that has a smaller cross-sectional area than the remainder of the support. This waist contributes towards increasing the resistance of the support and thereby the subsequent flow of heat into the tubular housing. The supports and the current input devices may, of course, be integrated with one another.

The energy balance in the furnace will also be disturbed by other heat conducting elements that are in direct contact with the surface of the tube-like furnace. An electric current can be passed through all such devices, wherewith said current can be brought into thermal energy equilibrium with the furnace surface 1 in combination with appropriately chosen dimensions of said devices or said waists. Two such devices are referenced 7, 8 in the figure.

FIGS. 2-6 illustrate five different embodiments of electrically conductive devices 2-6 according to the present invention, with dimensions being given in millimeters. As will be seen, the dimensions of the current input devices 2-6 are by no means small in relation to the diameter of the tube. It is necessary for the cross-sectional area of the devices 2-6 to have at least a given order of magnitude because of the strength of the heating current. Because the contact areas between the current input devices and the tube wall are of a substantial magnitude, the loss of heat through the current input devices is far from negligible.

The geometrical shape of the contact surfaces of the current input devices 2-6 can be chosen selectively to suit the remaining conditions of the embodiment, provided that the geometrical shape is of an order of magnitude that enables the present objects to be achieved.

The waist regions 10-12 on the current input devices 2-4 shown in FIGS. 2-4 are placed in close proximity to the temperature-controlled part of the furnace casing 1, as can be clearly seen from the figures.

Figure 7:
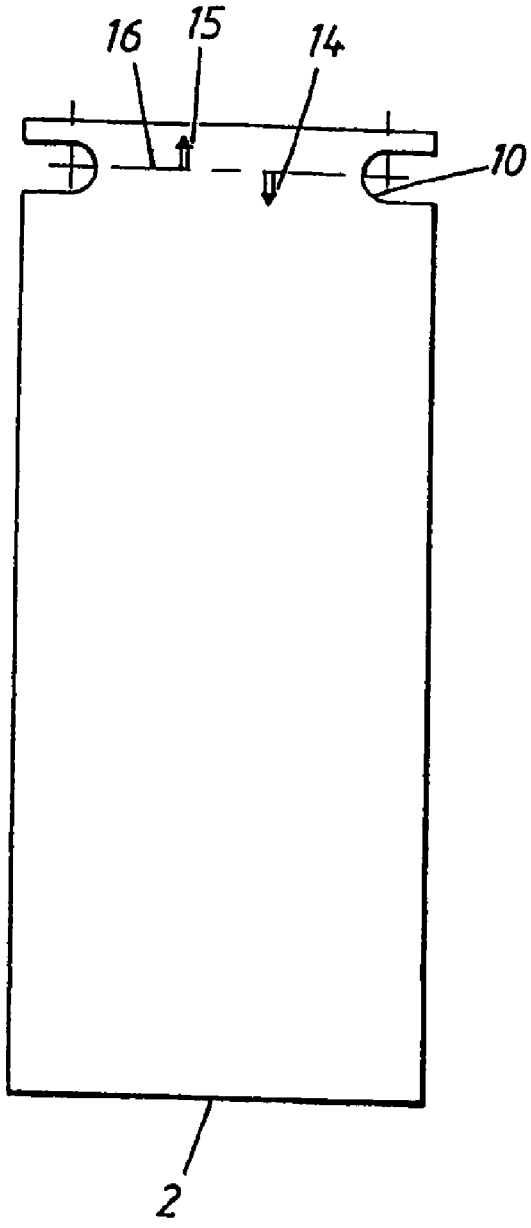
FIG. 7 is a cross-sectional view showing in more detail an example of a preferred embodiment of a current input device according to the present invention.
Figure 8:
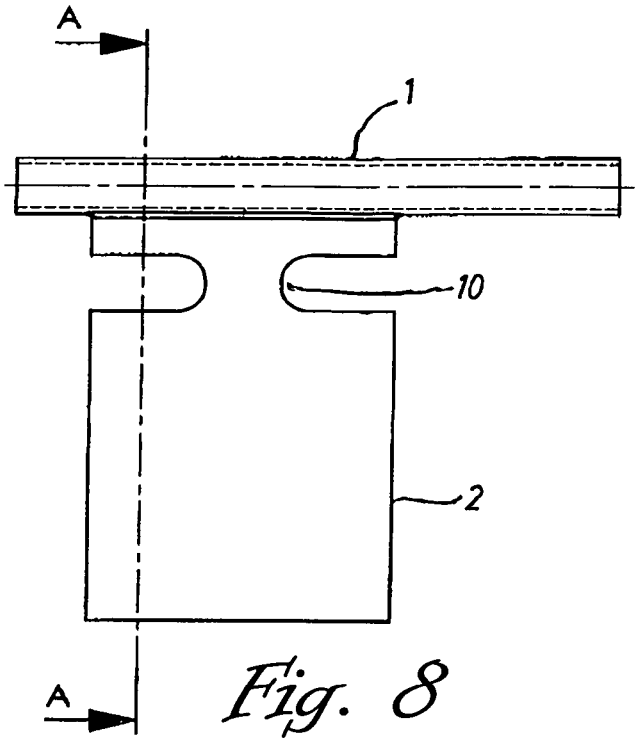
FIG. 8 is an enlarged fragmentary side view of a portion of FIG. 1.
Figure 9:
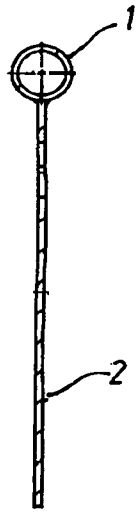
FIG. 9 is a cross-sectional view taken along the line A-A of FIG. 8.
Figure 10:
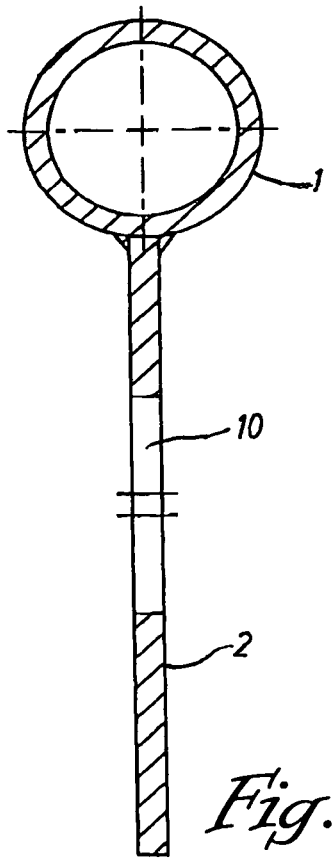
FIG. 10 is an enlarged cross-sectional view of the upper region of FIG. 9, showing the connection between a tubular furnace casing and a current input device.

FIG. 7 is a more detailed side view of an electric current input device 2 according to the invention. This figure shows the study of the vertical energy balance through a horizontal plane at the level of the waist 10 of said device 2. Heat lost from the furnace to the surroundings through said current input device is illustrated by the arrow 14. Electric current flowing through the waist of the current input device results in a balancing flow of heat into the tubular casing. This compensating heat flow is illustrated by the arrow 15. The net heat contribution of the energy flows illustrated by arrows 14, 15 can be controlled to equal zero by choosing a waist 10 cross-sectional area of suitable magnitude in relation to the operating temperature in the furnace casing 1, and of a suitable magnitude in relation to the current strength in the operation of the furnace.

Although the invention has been described above with reference to a number of exemplifying embodiments, it will be understood that the design of the current input devices, the number of said devices, and the number of current drainage devices can be varied, as can also the design of said waists.

The present invention shall not therefore be considered to be restricted to the described embodiments, since variations can be made within the scope of the accompanying claims.

What is claimed is:

1. A method of transmitting electric current to a furnace having a wall which is heated by electric current conducted into the furnace wall, said method comprising the steps of:

providing a furnace having an electrically conductive furnace wall that is heated electrically;

providing a plurality of spaced, electrically conductive current input devices that are in contact with an outer surface of the furnace wall and that have a main body portion; and forming in at least one of the electrically conductive current input devices at a position in close proximity to the outer surface of the furnace wall a region of the at least one current input device that has a smaller cross-sectional area than the main body portion of the at least one electrically conductive current input device, so that current flow toward the furnace wall through said smaller cross-sectional region of the at least one electrically conductive current input device develops a higher temperature than in the main body portion of the at least one electrically conductive current input device, to provide a local increase in heat flow from the at least one electrically conductive current input device to the furnace wall outer surface at the contact position of the at least one electrically conductive current input device with the furnace wall outer surface.

2. A method according to claim 1, including the steps of:

applying current to electrically conductive current input devices that lack a section of smaller cross-sectional area; and dimensioning the electrically conductive current input devices that lack a smaller cross-sectional area so that heat developed therein corresponds substantially with the heat flow from the at least one electrically conductive current input device that includes the region of smaller cross-sectional area.

3. A method according to claim 1, wherein the electrically conductive devices in contact with the furnace wall are selected from the group consisting of electric current input devices, electric current output devices, supports, measuring devices, and combinations thereof.

4. A method according to claim 1, wherein surfaces of the electrically conductive devices in contact with the furnace wall have a cross-sectional shape selected from the group consisting of square, circular, and rectangular shape; and the cross-sectional areas of the electrically conductive devices have substantially the same size.

5. A method according to claim 1, including the step of providing at least one electrically conductive current drainage device, wherein current flows through the furnace wall by delivering said current through the at least one current input device, and current passes from the furnace wall through the at least one current drainage device.

6. A method according to claim 1, including the step of providing in electrically conductive electrical current input devices placed in the proximity of a furnace volume where precision temperature control is desired waists that define smaller cross-sectional area regions of suitable dimensions for establishing a desired heat flow toward the furnace volume where precision temperature control is desired.

7. A method according to claim 1, including the step of producing the furnace as a tube-like furnace from FeCrAl.

8. An arrangement for transmitting electric current to a furnace having a wall which is heated by electric current conducted into the furnace wall, said arrangement comprising:

a furnace having an electrically conductive furnace wall that is heated electrically;

a plurality of spaced electrically conductive devices located in abutment with an outer surface of the furnace wall and having a main body portion, wherein at least one of the electrically conductive devices is an electrically conductive current input device and has close to said furnace wall a region which has a smaller cross-sectional area than the main body portion of the at least one electrically conductive current input device, so that electrical current passing through the smaller cross-sectional region develops a higher temperature than in the main body portion of the at least one electrically conductive current input device, to provide a local increase in heat flow from the at least one electrically conductive current input device to the furnace wall outer surface at the contact position of the at least one electrically conductive current input device with the furnace wall outer surface.

9. An arrangement according to claim 8, wherein electrically conductive current input devices that lack a section of smaller cross-sectional area carry current; and dimensioning the electrically conductive current input devices that lack a smaller cross-sectional area so that heat developed therein corresponds substantially with the heat flow from the at least one electrically conductive current input device that includes the region of smaller cross-sectional area.

10. An arrangement according to claim 8, wherein the electrically conductive devices in abutment with the furnace wall are selected from the group consisting of current input devices, current output devices, supports, measuring devices, and combinations thereof.

11. An arrangement according to claim 8, wherein areas of cross-sectional surfaces of the electrically conductive devices in contact with the furnace wall have shapes selected from the group consisting of square, circular, and rectangular shapes; and said cross-sectional surfaces have substantially the same sizes.

12. An arrangement according to claim 8, wherein at least one of the electrically conductive devices is a current drainage device, and wherein current flows through the furnace wall from current input devices to current drainage devices.

13. An arrangement according to claim 8, wherein electrically conductive current input devices placed in proximity to a furnace volume where precision temperature control is desired are provided with waists that define smaller cross-sectional area regions of suitable dimensions for establishing a desired heat flow toward the furnace volume where precision temperature control is desired.

14. An arrangement according to claim 8, wherein the furnace is a tubular furnace and is made of FeCrAl.

* * * * *